US006318049B1

(12) United States Patent
Raudat et al.

(10) Patent No.: US 6,318,049 B1
(45) Date of Patent: Nov. 20, 2001

(54) SLITTER MACHINE FOR TAB LOCK CASES

(75) Inventors: John L. Raudat, Kalispell, MT (US); Emilio N. CoFrancesco, Middletown; Jeffrey Reilly, Meriden, both of CT (US)

(73) Assignee: Standard Knapp Inc., Portland, CT (US)

( * ) Notice: Subject to any disclaimer, the term of this patent is extended or adjusted under 35 U.S.C. 154(b) by 0 days.

(21) Appl. No.: 09/606,545

(22) Filed: Jun. 29, 2000

Related U.S. Application Data

(62) Division of application No. 09/174,947, filed on Oct. 19, 1998, now abandoned.

(51) Int. Cl.[7] ..... B26D 1/03; B65B 7/20

(52) U.S. Cl. ..... 53/377.2; 53/376.4; 53/375.4; 53/378.3; 83/76.9; 83/431; 83/444; 83/112; 83/858; 83/946; 493/25; 493/56; 493/179; 493/183; 493/357

(58) Field of Search ..... 53/376.4, 377.2, 53/266.1, 284.5, 286, 373.2, 375.4, 382.2, 378.3; 493/56, 162, 177, 178, 179, 180, 182, 183, 356, 357, 25, 359, 34, 8; 83/830, 76.9, 861, 522.26, 422, 112, 431, 151, 444, 159, 523, 166, 858, 946

(56) References Cited

U.S. PATENT DOCUMENTS 3,224,165 * 12/1965 Nigrelli et al. ..... 53/382.2
3,345,799 * 10/1967 Hickin ..... 53/377.2 X
3,546,839 * 12/1970 Comstock ..... 53/377.2 X
4,124,969 11/1978 Peyton .
4,177,619 12/1979 Hartness et al. .
4,203,271 5/1980 Raudat .
4,293,086 * 10/1981 Fincher et al. ..... 225/1
4,302,919 12/1981 Hartness .
4,522,014 6/1985 Robinson .
4,551,964 11/1985 Johnson .
4,569,181 2/1986 Raudat .
4,587,792 5/1986 Hartness et al. .
4,642,966 2/1987 Marchetti .
4,698,950 10/1987 Marchetti .
4,805,375 * 2/1989 Langen et al. ..... 53/142
4,972,654 11/1990 Marchetti .
5,269,742 12/1993 Crouch et al. .

* cited by examiner

*Primary Examiner*—Boyer Ashley
(74) *Attorney, Agent, or Firm*—Cantor Colburn LLP

(57) ABSTRACT

A slitter machine of the type where tab lock cases of varying height, width, and length are advanced therethrough in a product flow direction on a machine bed by a main drive motor, is presented. The slitter machine includes a frame, a centerline, a leading flap lifter and a trailing flap lifter. The leading flap lifter and trailing flap lifter are mounted are mounted to the frame on opposite sides of the centerline, and extend at an incline relative to the machine bed. Each flap lifter includes a tear drop assembly attached to a drive chain and actuated by a pair of cams to rotate the leading flap and the trailing flap toward a closed position. A chain track is disposed in each of the flap lifting assemblies, with the drive chains disposed therein. Each chain track has a first section having a first distance between the drive chains and a second section having a second distance between the drive chains. The second distance is greater than the first distance.

12 Claims, 14 Drawing Sheets

SLITTER MACHINE FOR TAB LOCK CASES

This application, Ser. No. 09/606,545 is a divisional of U.S. application Ser. No. 09/174,947, filed Oct. 19, 1998, now abandoned.

BACKGROUND OF INVENTION

FIELD OF INVENTION

Slitter machines of the prior art are designed to complete the packing process on filled tab lock corrugated cases. The machine's in-line design initially slits the tab-locks on filled corrugated cases, positions the loose flaps for sealing, and seals the flaps with a series of hot glue guns. The case is then sealed and discharged on a compression conveyer. Many of the machines of the prior art are designed to accommodate cases of varying size and as such are quite complex.

An in-line slitting machine of the prior art is discussed in U.S. Pat. No. 4,551,964 (the '964 patent), commonly assigned to applicant and incorporated herein by reference, which eliminates the need to turn the case. The machine of the '964 patent applies pressure to the sides of the case, and exposes the tab-locks for cutting.

Filled corrugated cases are fed into the slitter portion of a slitter machine. The cases are directed into the machine, held down by rollers, and indexed onto an infeed lug chain. The rollers hold the case down, ensuring it does not jump the leading lug on the infeed lug chain. The leading lug serves as the infeed timer and controls the entry of cases into the machine.

The infeed chain then separates the cases and directs them toward the main flight chain, using rubber side-drive chains. The side-drive chains grip the case horizontally, controlling it as it advances toward the main flight chain. The side drive chain runs at the same speed as the main flight. The main flight chain includes flight lugs which lift the leading edge of the case and twist it. The case is twisted to expose the front and rear tabs to a pair slitter knife guides. The slitter knife guides incorporate a sharpened edge along their upper portion functioning as a knife. As the case passes through the knife guides, the tab locks are cut. Once through the slitter, the end flaps are then raised by an end flap lifter and directed through a flap tucker which closes the front and rear flaps, leaving the side flaps in a down position.

Once the case has passed through the flap tucker, the side flaps are lifted by flap guides. These guides ensure that the side flaps are lifted up and away from the side of the case as it exits the slitter section. This step is accomplished to avoid any binding of the flaps. As the case moves out of the slitter section, it is indexed onto a conveyor belt at the infeed of the sealer section. The case then enters a set of flap guides, which control the position of the flaps as they enter the glue applicator.

Once the case has entered the glue section, the side flaps remain upright until the glue is applied to the inside of the flap. The case is then directed forward into a compression section, which closes the two side flaps using flap guides and seals the case using a series of rollers. The cases are then discharged from the machine onto the customer's discharge conveyor.

The infeed timer uses wedge-shaped steel lugs mounted to a pair of timing chains perpendicular to product flow to ensure that the cases enter the slitter at the rate of movement of the flight chain. The lugs are moveably positioned at a distance less than the desired case length apart along the chains. The timing chains are mounted between two side-drive chains such that a case is accelerated forward against a first lug and is raised up on top of a second following lug. When the first lug passes the end of the infeed timer, the case is accelerated downstream by the side drive chains. The timer is mechanically synchronized to release one case into the slitter in time with the main flight chain, located downstream. The pair of side-drive chains operate at the same speed as the main flight chain, and have two sections of rubber lugs that propel the cases forward against the timer lugs. One problem with the timer of the prior art is the time and accuracy required to effect a changeover for a different case size. The lugs must be mechanically removed from the timing chains, a sample case positioned on the conveyor and the lugs must be repositioned for the newly desired case length. Frequent case size changeovers cause problems with lug and fastener wear, chain stretch, drive sprocket alignment and wear, leading to timing problems between the infeed section and the warping section of the machine. Another problem with the prior art is that the case may be dropped into the flight chain too early either because the side drive chain is not properly positioned or the side drive chain width is set too wide. These problems are caused by the fact that physical movement of separate elements to effectuate case size changes are required, including case width adjustment of the drive chains and advance or retard of the side drive chain.

The main flight chain transports the cases from the timer through the slitter guides, end flap lifters, and the flap tucker section. After directing the cases through these sections, the flight chain then discharges the cases from the slitter to the transfer conveyor. The flight chain is made up of two flat-top chains having, for example, 12 sets of leading and trailing flight lugs, attached thereto. The main flight chains ride on plastic tracks for minimal noise and friction. Each set of flight lugs carries and controls one case. The leading edge of a case rests on a set of leading flight lugs and is prevented from sliding off by the associated trailing flight lug. The leading flight lugs are fixed along the main flight chains at an interval less than the smallest desired case length. The trailing flight lugs are mechanically moveably connected to the main flight chains to allow positioning of the trailing flight lug further from, or closer to, the preceding flight lug to accommodate a full range of case lengths in, for example, six 1.5 inch increments. A stationary cam is located near each chain having a profile to contact the flight lugs such that the cases are lifted and twisted as they advance along the flight chain. A problem with the prior art transport chain is the time required to make a case size changeover. In order to effect a changeover, all 12 sets of lugs must be removed from the chains and reinstalled at the proper position. Frequent changeovers also lead to wear of the lugs and fastening elements. In addition, the flight chains of the prior art are relatively long and the weight of the lugs causes the chains to stretch which leads to wear, alignment and timing problems.

The tab lock slitter guides of the prior art mount two spring-loaded blades vertically on either side of the main flight chain. As the flight lugs advance up their respective cams, lifting and twisting the case, the front and rear tab-locks are exposed to the blades. The knife guides are wedged into the gaps created between the case and its side flaps as the case proceeds along the chain. As the flight lugs ride down their respective cams, the case is forced down onto the knives, thus cutting the tab-locks. Each case is held in place by a case hold-down, which is suspended from a side of the machine frame and positioned above the case. One problem with tab lock slitters of the prior art is their limited ability to accommodate the deviation in position of the tab locations. If the tabs of a certain case are too high for instance, the knife will fail to completely slit the tab causing a machine jam. An additional problem with tab lock slitters of the prior art is that there exists a limited amount of accuracy available in accommodating different case sizes. For instance, case centering is changed by physically loosening both sets of knife guides placing a case on the main flight chain and moving the guides within a prescribed distance from the case while ensuring parallelism of the guides. Improper adjustment of the guides can result in erratic tab lock slitting. The integral knife guide/blades of the prior art also pose a problem of edge sharpening and blade replacement. In order to effect a blade change or to sharpen the knife edges the guides must be remove from the machine causing delays and down time.

The end flap lifters of the prior art consist of a pair of flat-top chains, mounted vertically on both sides of the main flight chain. Teardrop shaped lugs, controlled by cams on inclined frames, lift both the front and rear flaps as a case advances downstream. The teardrop on the right side of the machine lifts the leading case flap, while the teardrop on the left side lifts the trailing case flap. The chains also transport wedge-shaped lugs which prevent the side case flaps from springing outward as the case passes between the teardrops.

The flap tucker of the prior art is a slotted, rotating disc, followed by a horizontal plow, located at the discharge end of the slitter. Just as the leading flap is pushed to a vertical position by the teardrops, it strikes the flap tucker and is folded downward into the case. As the trailing flap is pushed to a vertical position by the teardrops, it enters the slot in the flap tucker and is forced down. The case is then passed through a plow, which holds the front and rear flaps down as it exits the slitter and enters the sealer. Problems resulting from improper case changeover adjustment or wear include timing problems where the tear drops lifting the cases or the flaps not lifting, or where the tear drop width adjustment is incorrect causing centering problems. The tear drop assemblies of the prior art comprise a cantilevered mounting arrangement which contributes to wear and alignment problems.

As described hereinabove, slitter machines of the prior art function to accommodate tab lock cases of various sizes. In order to accommodate the diverse case sizes mechanical adjustment of numerous elements of the machine is required. Starting with the infeed section, a case of new dimension is placed in the infeed roller position and the infeed roller adjustment bolts are loosened to position the roller within a prescribed distance above the case and then retightened. The infeed rollers are then manually centered over the edge of the case by loosening a pair of adjustment handles. The width of the side-drive chain must next be adjusted by loosening several hold down bolts on the pair of side-chain drive units, placing several filled cases of product between the units, manually adjusting the space between the units within a prescribed distance from the cases and equidistant from the centerline of the machine, then retightening the hold down bolts.

Next, the case pocket length must be adjusted to accommodate the new case length. A case is placed on the main flight chain between a leading and a trailing flight lug and the trailing lugs are removed and repositioned to within a prescribed distance from the case and reattached ensuring that the pairs of trailing lugs are parallel. The machine must be jogged forward until all 12 sets of lugs have been adjusted to the correct pocket length. The knife guides must next be adjusted to accommodate a new case height or width. The width of the knife guides are adjusted by placing a case in the pocket moving the guides within a prescribed distance from the case ensuring that the guides are equidistant from the centerline of the machine. The height of the knife guide is adjusted by loosening a pair of locks which hold the knives in place and then manually moving the knife guide to within a prescribed distance of the tab lock on the leading end of the case and then the locks are re-engaged.

The case flap guide must also be adjusted during a case size change and is effected by positioning a case first in the infeed timer section and then in the main flight chain and loosening a plurality of mounting bolts and manually raising the guides such that the flaps are retained within the guides and that the guides are within a prescribed distance from the sides of the case and are equidistant from the centerline of the machine.

Next the rear flap lifters must be adjusted to accommodate a case change. The front flap lifters are timed with the leading end of a case and the flap tucker and therefore do not require adjustment during changeover. To adjust the rear flap lifter adjustment, bolts on the drive shafts are loosened and the shafts are manually turned to position the flap lifter in proper orientation with the case. The case guides are also adjusted to accommodate a width change on a case by placing a case within the guides and loosening the hold down bolts on the pair of case guides and positioning the guides within a prescribed distance from the case and equidistant from the centerline of the machine, then the hold down bolts are retightened. The flap lifter width is adjusted similar to the case guides to accommodate a case width change ensuring that the flap lifters are equidistant and parallel to the centerline of the machine. Next the height of the flap tucker must be adjusted to accommodate each case height change. The flap tucker is adjusted by loosening an adjustment handle and placing a case under the flap tucker and manually positioning the flap tucker within a prescribed distance from the case. The timing of the flap tucker must also be adjusted to accept a new case size and it is effected by loosening the bolts that attach the flap tucker to its drive shaft, placing a case on the flight chain and jogging the machine to position the case under the tucker locating the vertical flap into the disc cutout with a prescribed clearance. The bolts are retightened and the machine jogged to ensure the proper adjustment.

What is needed is a slitter machine which can accommodate frequent case size changes with a minimum amount of time, expertise and effort, without requiring the use of tools, and without the deleterious effects on the life of the machine parts.

SUMMARY OF THE INVENTION

The above discussed and other drawbacks and deficiencies of the prior art are overcome or alleviated by the present invention.

This invention relates generally to machines for slitting tabs on tab lock cases. In particular this invention relates specifically to improvements to a slitter machine for adjusting various mechanisms within the machine to accommodate cases of varying sizes.

A slitter machine according to the present invention includes an infeed roller section having a vertical adjustment mechanism for quickly and accurately positioning a set of infeed rollers at the top of the cases. The mechanism advantageously includes a scale and pointer that cooperate to provide a number corresponding to the height of the case.

A novel timing section is included in a slitter machine in accordance with the present invention for releasing cases to the transport and warping section of the slitter machine at a predetermined rate. The timing section advantageously includes two sets of timing chains having lugs to engage the front end of the cases as delivered by transport chains driven by a main drive motor. The timing chains are driven by an adjustable drive mechanism at a generally constant speed just less than the transport chains while in contact with the case. The adjustable drive mechanism varies the speed of the set of lugs not in contact with the case to varying the distance between the lugs thereby accommodating cases of different length. In an embodiment of the present invention the adjustable drive mechanism is a pair of servo motors.

The knife guides of a slitter machine in accordance with the present invention include a height adjustment mechanism positioned at both their upstream end and downstream end permitting quick and accurate accommodation of cases of varying height. The adjustment mechanism is a screw device which raises and lowers the knife guides in relation to the machine bed. The mechanism advantageously includes a scale and pointer that cooperate to provide a number corresponding to the height of the case. In an embodiment of the present invention the height adjustment mechanism includes a ratchet handle for applying rotation to the screw device. In embodiments within the scope of the present invention the height adjustment mechanism advantageously includes a motor for applying rotation to the screw device. In yet other embodiments the knife guide of the present invention includes removable knife blades to facilitate sharpening and enhance slitting of the tab locks.

The case guides of a slitter machine in accordance with the present invention are adjustable about the centerline of the machine to accommodate cases of varying width. Adjustment is performed simultaneously to each case guide by a master guide adjuster where the case guides are attached to mounting plates that slide in and out relative to the machine centerline. The master guide adjuster includes a single input shaft driving a pair of right angle gearboxes having two out put shafts attached to each. Mounted to the output shafts are a plurality of pinion gears positioned to mesh with a plurality of rack gears attached to the mounting plates. Rotation of the input shaft rotates the output shafts and the gears in meshing arrangement slide the mounting plates in and out relative to the centerline thereby effecting a width change. The rotation may either be provided manually by a ratchet handle disposed in the input shaft or by a motor coupled to the input shaft. The master guide advantageously includes a pointer mounted to the frame of the machine and a scale attached to the mounting plate which cooperate together to provide a number corresponding to the width of a case.

A trailing flap lifter and a leading flap lifter are provided which include tear drop assemblies driven by a main motor and actuated by cams to rotate the flaps toward a closed position. The tear drop assemblies are disposed within a chain track which positions the tear drop assemblies in contact with the cases at the upstream end of the lifters and positions outside of the travel path at the downstream end of the lifters. The leading flap lifter is also provided with a an adjustable drive mechanism capable of varying the distance between the tear drops of the trailing flap lifter and those of the leading flap lifter thereby accommodating cases of different length. In an embodiment of the present invention the adjustable drive mechanism is a servo motor. In other embodiments within the scope of the present invention the adjustable drive mechanism includes a stepper motor, or a harmonic drive or a mechanical timing hub.

The flap lifters of the present invention also include a cam adjustment mechanism for quickly and accurately changing the position at which the tear drops are actuated. The cam adjustment mechanisms include a scale and pointer which cooperate together to provide a number corresponding to a case height thereby allowing accurate positioning of the cams to accommodate a case height change.

The tear drops of the present invention are attached to pivot shafts simply supported within a pivot casing which reduces wear of the assembly and also enhances the alignment of the tear drop in relation to the minor flaps.

The flap tucker wheel of the present invention is coupled to an acceleration device to provide an instantaneous increase in speed to assist in positioning the trailing flap in a closed position. The acceleration device overdrives the main drive of the tucker wheel just prior to the tucker point impacting the trailing flap to compensate for the forward speed of the case as it travels through the slitter. The acceleration device of the present invention includes a servo motor.

The flap tucker of a slitter machine in accordance with the present invention includes a height adjustment mechanism for quickly and accurately adjusting the height of the tucker wheel in relation to the machine bed. The height adjustment mechanism includes a mounting frame attached to the slitter machine frame including a rack gear attached thereto. The tucker wheel is slidably attached to the mounting frame and has a pinion gear attached to it in meshing arrangement with the rack gear such that a rotation of the pinion gear moves the tucker wheel up or down in relation to the machine bed. In an embodiment of the present invention a hand crank is coupled to the pinion gear for applying rotation thereto. In other embodiments within the scope of the present invention a motor is coupled to the pinion gear for applying rotation thereto. The height adjustment mechanism includes a scale attached to the mounting frame and pointer attached to the tucker wheel which cooperate together to provide a number corresponding to a case height thereby allowing accurate positioning of the tucker wheel to accommodate a case height change.

An embodiment of the present invention includes a microprocessor including an input terminal to electronically position certain of the elements of the slitter machine to accommodate cases of different sizes. The microprocessor produces electronic signals in accordance with operator input corresponding to case dimension to effect position changes of the input rollers, timing section stepper motors, lifting lugs, master case guides, tear drop cams, flap tucker position and speed, and knife guide assemblies.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 2A' is a top plan view of the infeed timer section of a tab lock slitter machine in accordance with the present invention;

DETAILED DESCRIPTION OF THE PREFERRED EMBODIMENT

Figure 1:
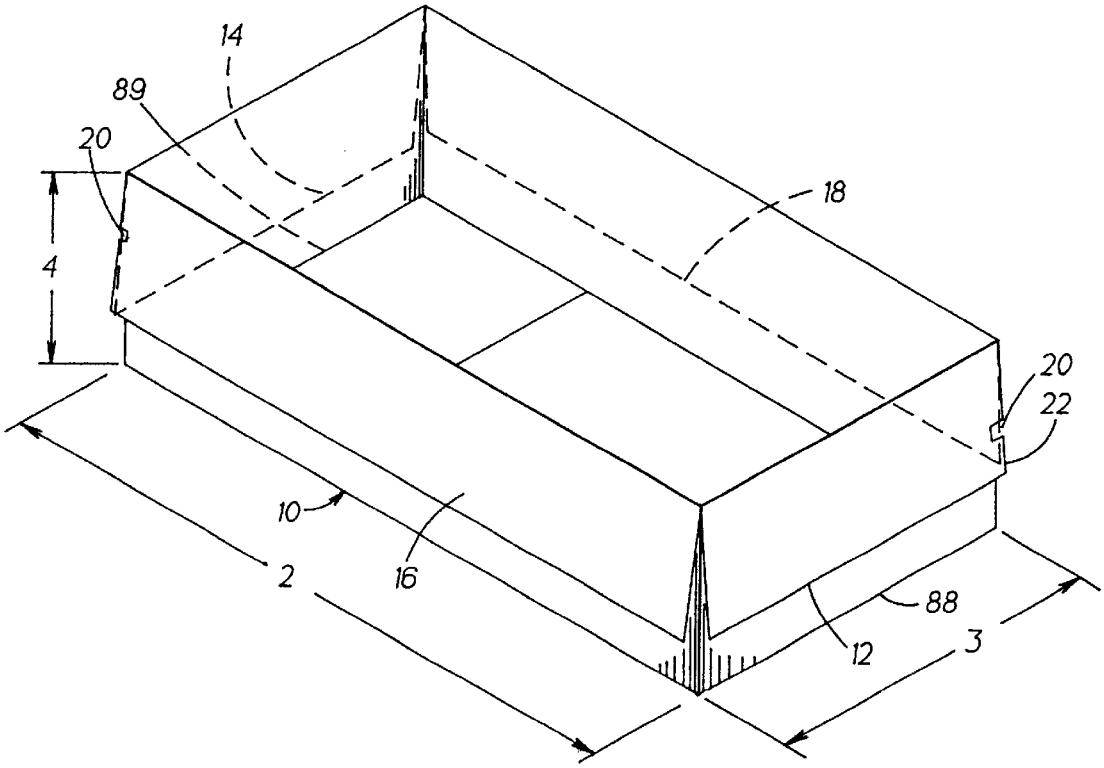
FIG. 1 is a three dimension view of a tab lock case.
Figure 2A:
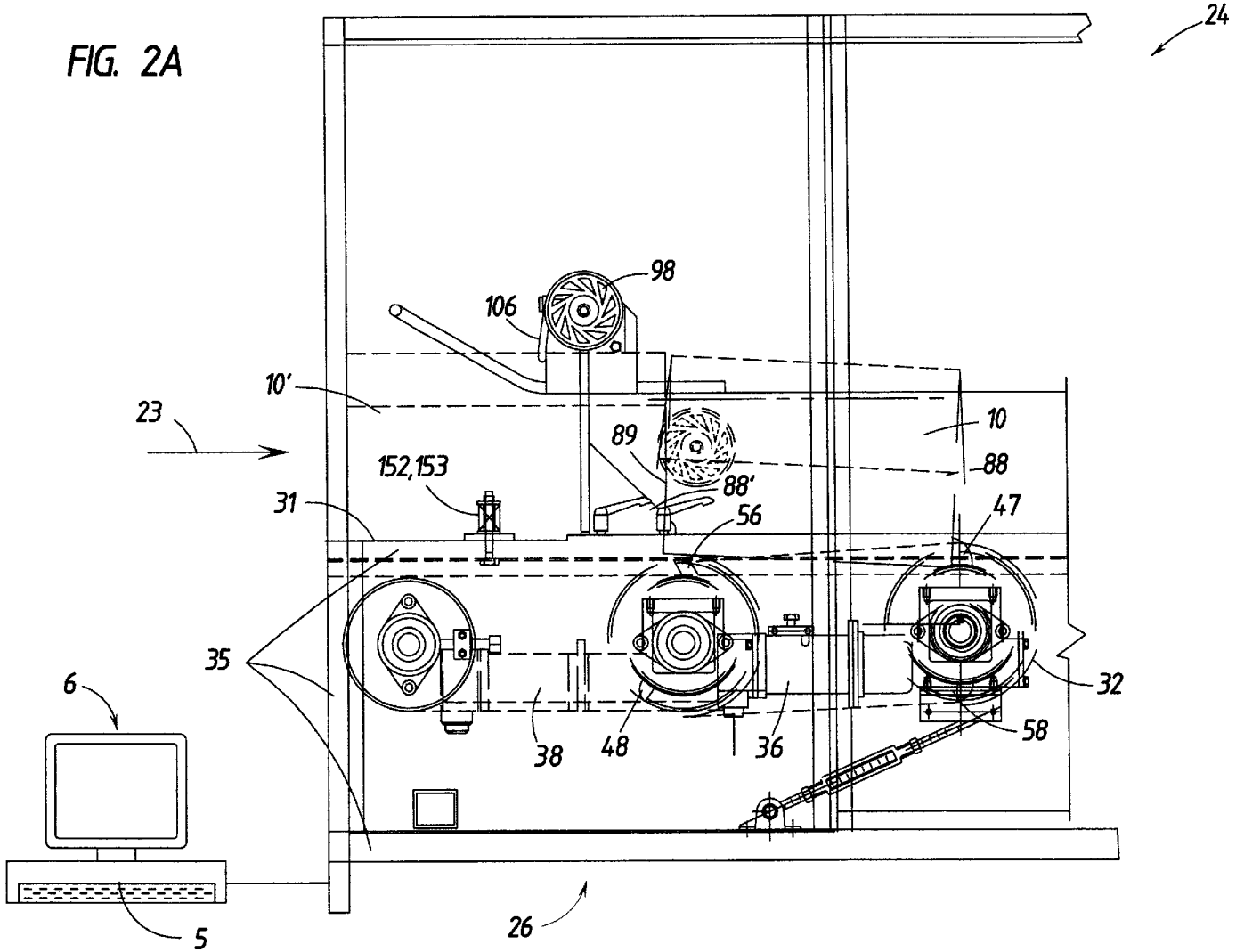
FIG. 2A is a side plan view of the timer infeed section of a tab lock slitter machine in accordance with the present invention.
Figure 2B:
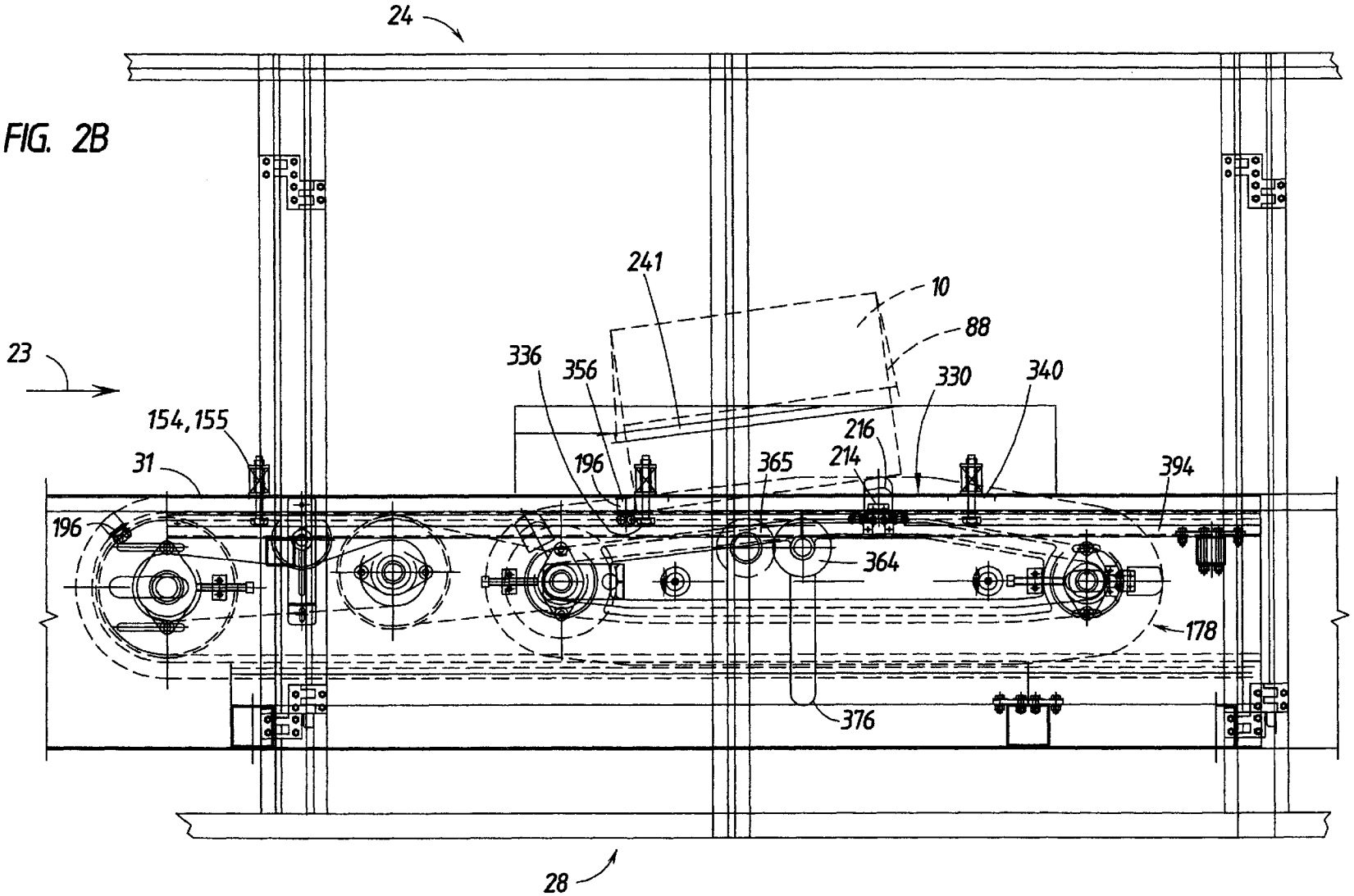
FIG. 2B is a side plan view of the lifting and warping section of a tab lock slitter machine in accordance with the present invention.
Figure 2C:
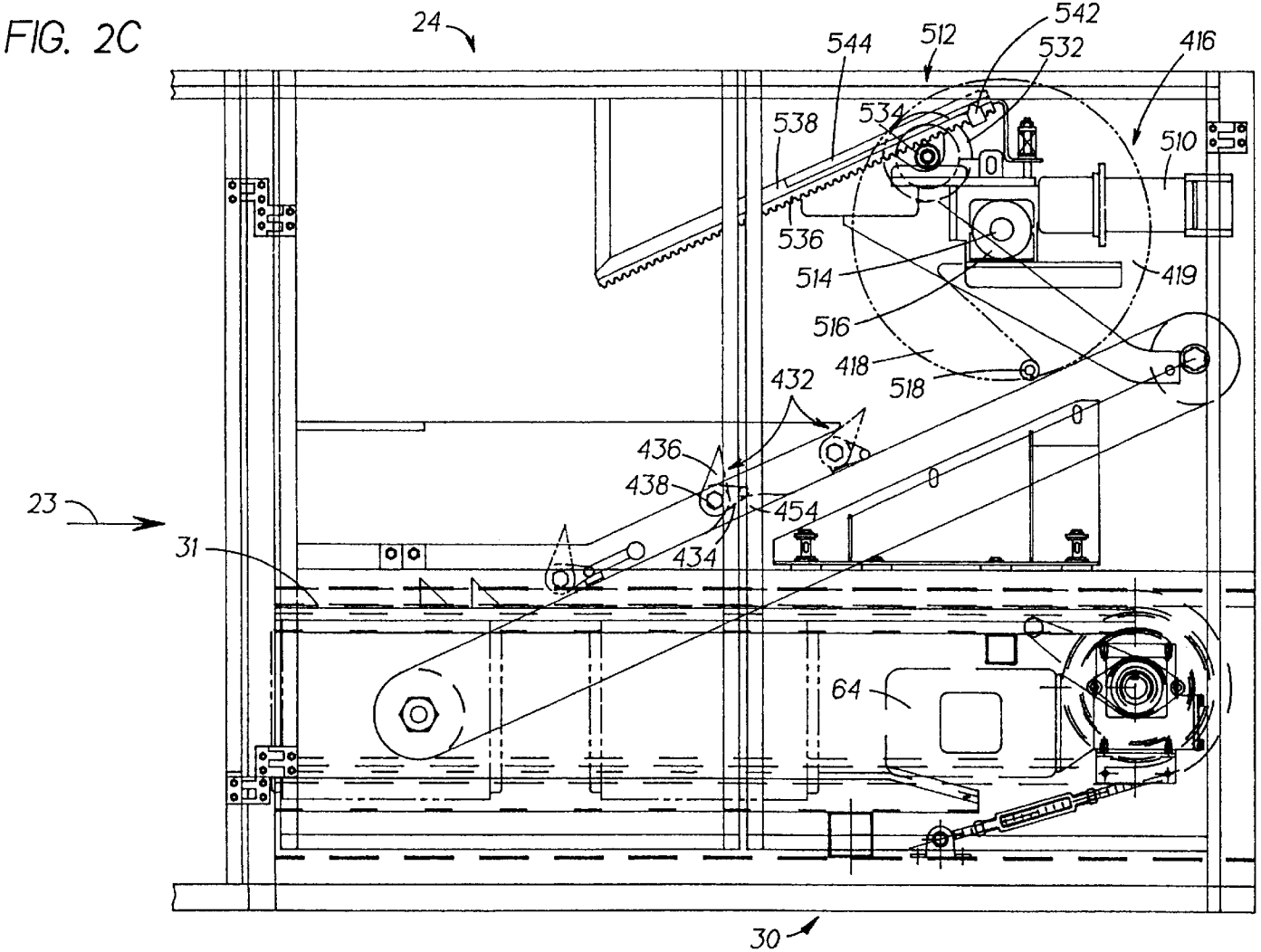
FIG. 2C is a side plan view of the flap tucker section of a tab lock slitter machine in accordance with the present invention.
Figure 2A:
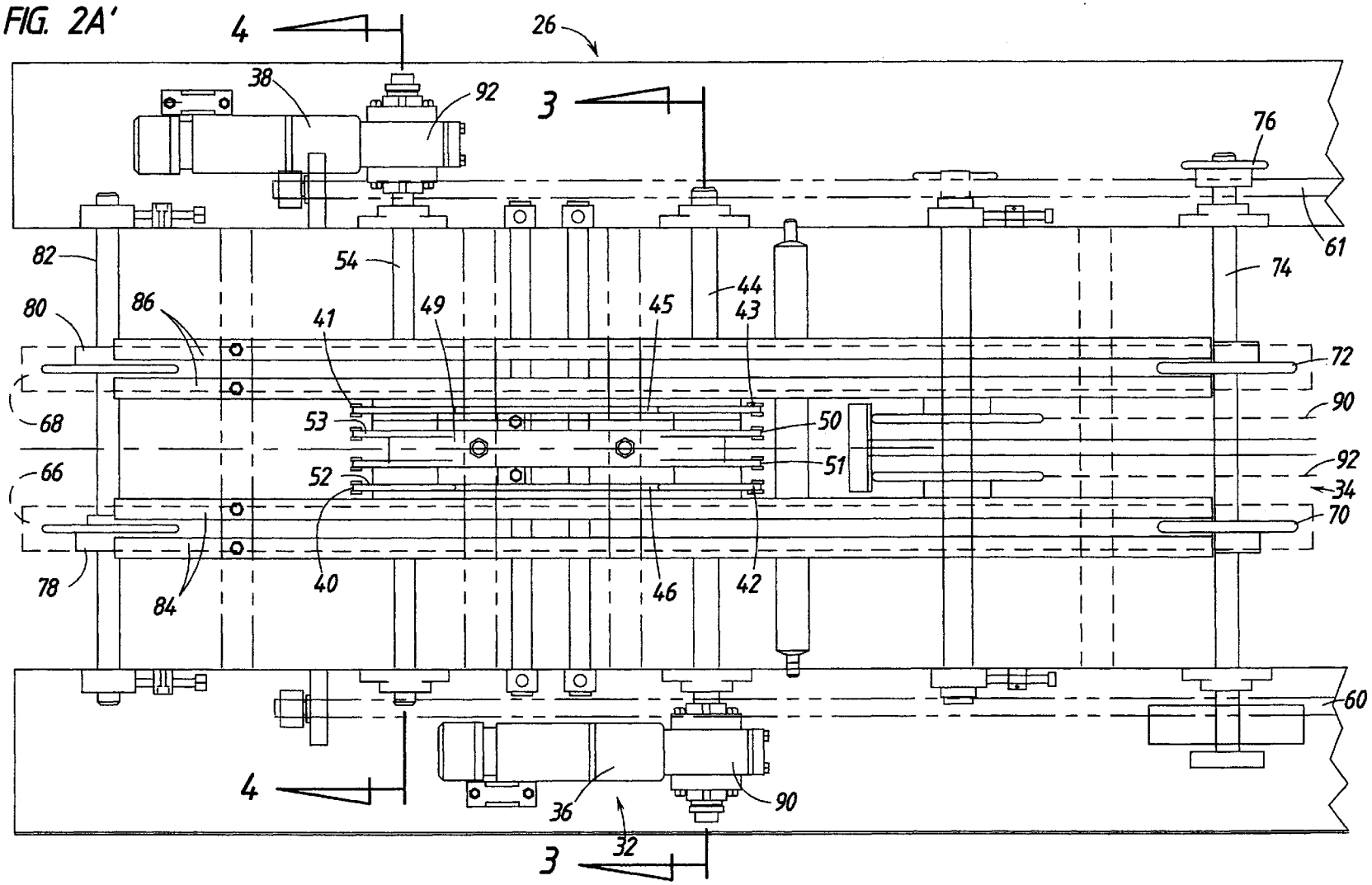
Figure 3:
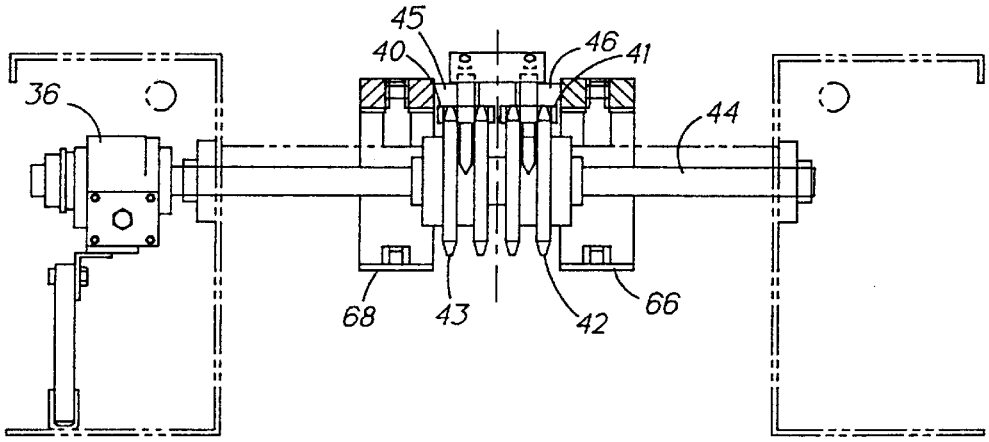
FIG. 3 is a section view of the infeed timer section taken along 3—3 of the tab lock slitter machine of FIG. 2A'.

Referring to FIG. 1 there is shown a tab lock case generally indicated as having a length 2 a width 3 and a height 4 and including end flaps 12, 14 and side flaps 16, 18. The flaps are held in an open position as shown by tab locks 20, 22 which connect side flap 16 to end flap 14 and side flap 18 to end flap 12 respectively. The tab locks 20, 22 are positioned on opposite corners as is well known in the art. Tab locks 20, 22 of case 10 are slit and flaps 12, 14, 16, 18, 20, 22 are manipulated into a closed position in accordance with the present invention by a slitter machine 24 as best shown in FIGS. 2A, 2B, 2C. The slitter machine 24 includes a case infeed section 26, (FIGS. 2A and 2A') a transport and warping section 28 (FIG. 2B) and a flap tucker section 30 (FIG. 2C). Cases 10 are fed into slitter 24 at infeed section 26 end to end in a continuous fashion and move from left to right as viewed in FIG. 2A and indicated by arrow 23 and exit the sitter from flap tucker section 30 (FIG. 2C) while traveling along at a generally horizontal plane defined by machine bed 31.

Figure 4:
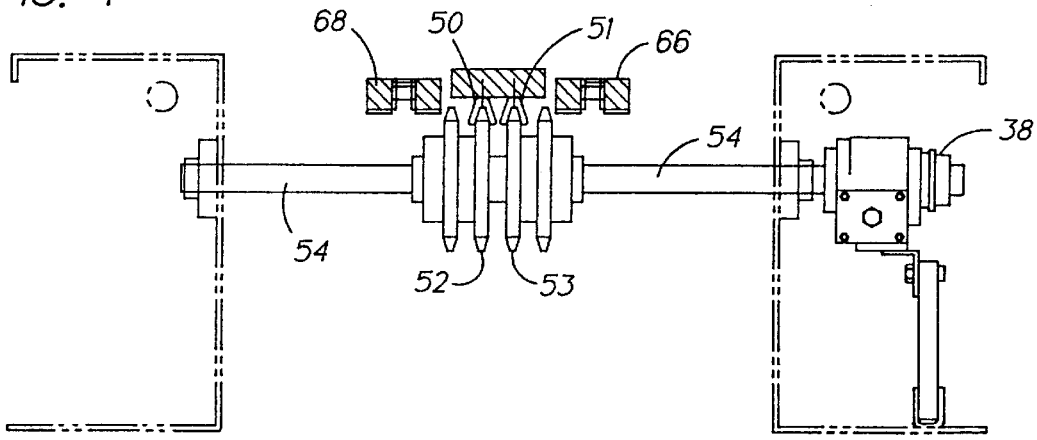
FIG. 4 is a section view of the infeed timer section taken along 4—4 of the tab lock slitter machine of FIG. 2A'.

Infeed section 26 includes infeed timer 32 and transport assembly 34 (FIG. 2A'). As best shown in FIG. 2A' infeed timer 32 includes servo motor 36 which drives timer chains 40, 41 via drive sprockets 42, 43 mounted to drive shaft 44 as will be more fully explained herein below. Lugs 47, 48 (FIG. 2A) are attached to timing chains 40, 41 and ride on inner tracks 45, 46 and center track 49. As best shown in FIG. 4 infeed timer 32 further includes servo motor 38 which drives timer chains 50, 51 via drive sprockets 52, 53 attached to drive shaft 54 as will be more fully explained herein below. Lugs 56, 58 (FIG. 2A) are attached to timer chains 50, 51 and also ride on inner tracks 45, 46 and center track 49.

Referring to FIG. 2A', transport assembly section 34 includes a pair of flat-top chains 66, 68 driven by drive sprockets 70, 72 mounted to drive shaft 74 and connected to main drive motor 64 (FIG. 2C) via drive sprocket 76 and rotate on idle sprockets 78, 80 mounted on idle shaft 82. Flat-top chains 66, 68 are supported along their length by two sets of outer tracks 84, 86.

In operation, a line of cases 10 are continuously fed into the infeed section and onto the flat-top chains 66, 68 of the transport assembly 34 as shown in FIGS. 2A and 2A'. Leading edge 88 of case 10 is propelled into lug 47 by successive case 10' and the back portion of case 10 is lifted by lug 56 and therefore the timing of delivery of successive cases 10 to transport and warping section 28 (FIG. 2B) is controlled by the speed of lug 47. Case 10 is transferred to case transport, or main flight, chains 60, 61 (FIG. 2A') when lug 47 rotates about axle 44 and out of the way of leading edge 88 as is known in the art. The leading edge of subsequent case 10' is then propelled into lug 56 which controls its timed release onto main flight chains 60, 61.

During operation, the timer section 32 is driven by servo motors 36, 38. During a machine change over to accommodate a case length 2 change, servo motors 36, 38 are operated to change the distance between lugs 47 and 56 and between lugs 48 and 58. The nominal distance between these lugs is an inch or so less than length 2 of case 10. The servo motors 36, 38 overdrive shafts 44, 54, with respect to main drive chains 60, 61, at different speeds from one another to effect the length change. During a case length change an operator accesses software resident in processor 5 of operator station 6 (FIG. 2A).

An operator selects a case length and processor 5 controls servo motors 36,38 to adjust the length between lugs 47 and 56. Once lug 47 rotates out of the way of leading edge 88 servo motor 36 is sped up or slowed down to position lug 48 within an inch or so of the trailing edge 89 of case 10. The process is the same for the positioning of lug 58 once lug 58 rotates out of the way of leading edge 88 of case 10.

Figure 5A:
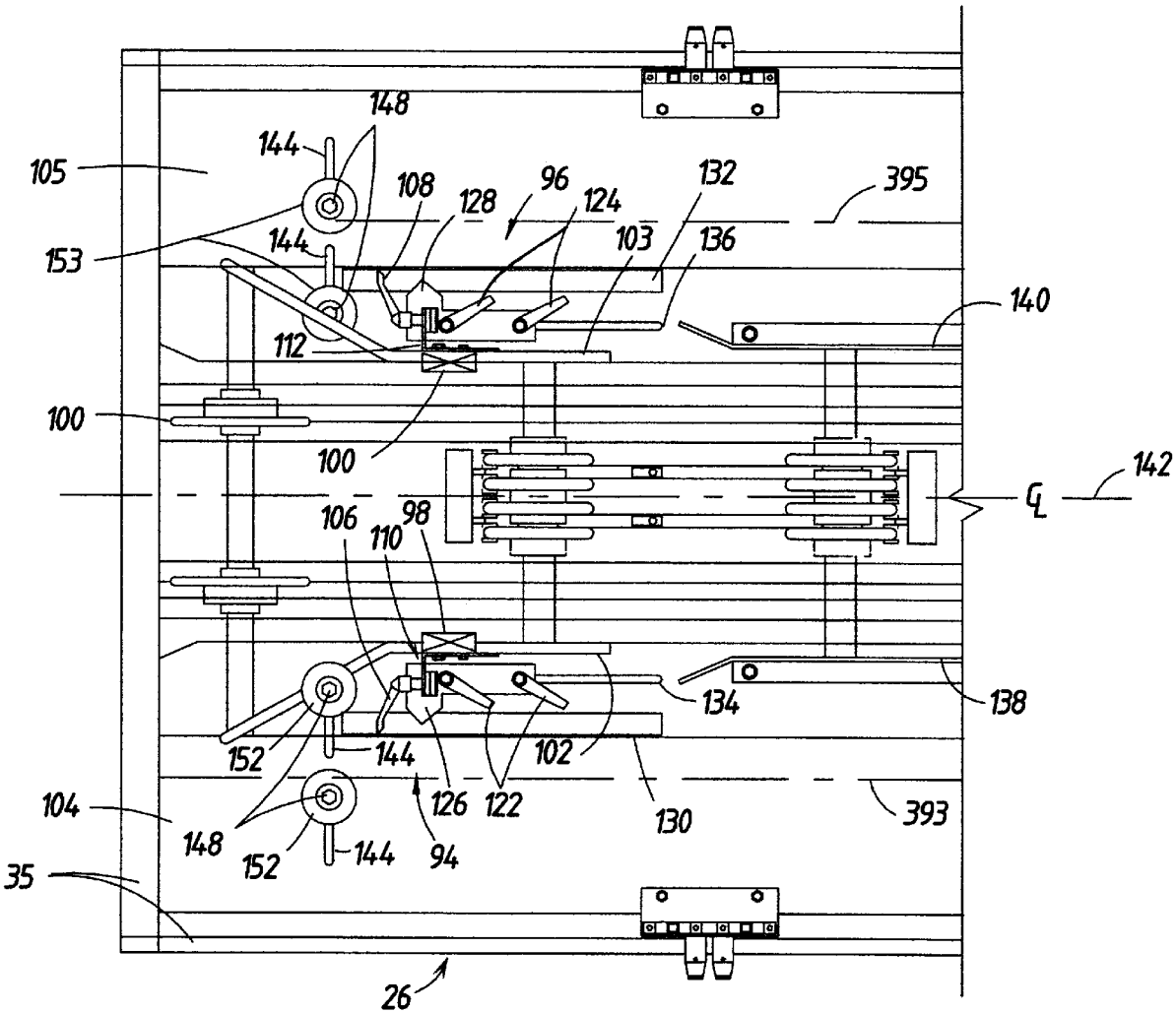
FIG. 5A is a top plan view of the timer infeed section of a tab lock slitter machine in accordance with the present invention.
Figure 8A:
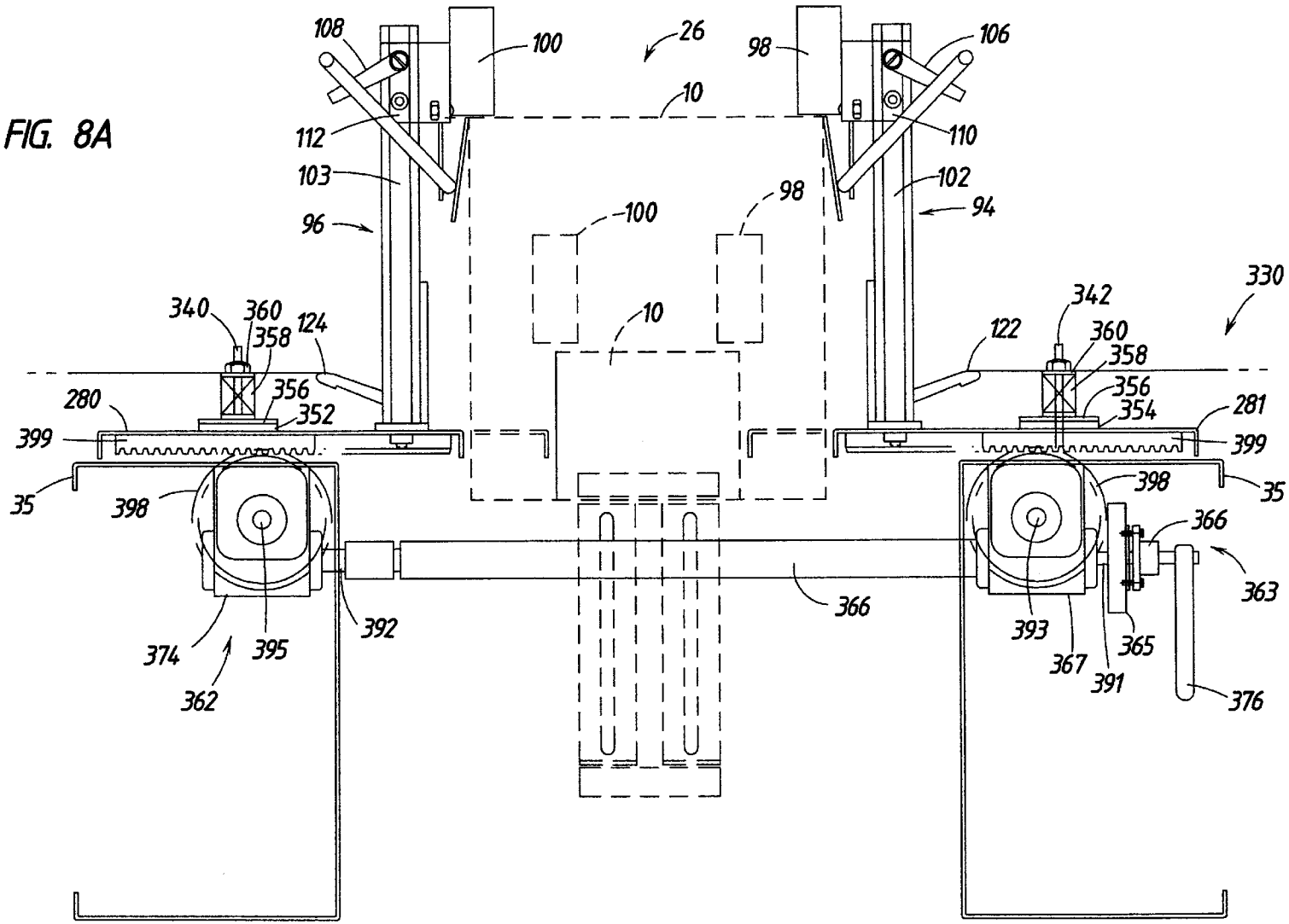
FIG. 8A is an end plan view of the master guide adjuster.

Infeed section 26 further includes case hold down roller assemblies 94, 96 as best shown in FIGS. 5A and 8A and includes hold down rollers 98, 100 mounted on roller stands 102, 103 and mounting plates 104, 105 and attached to machine frame 35 at the upstream end of the infeed sections as will be explained more fully herein below, Hold down roller assemblies 94, 96 function similar to that of the prior art as described herein above but include elements which improve case size changeover operations. Vertical quick release levers 106, 108 are threadably engaged within the forward facing portions of stands 102, 103 and releasably secure rollers 98, 100 in a preselected vertical position on mounting assemblies 110, 112 during normal operation of the slitter 24. Mounting assemblies 110, 112 include an integrally mounted pointer (not shown) which, when combined with a scale (not shown) mounted on the forward face of stands 102, 103, indicate a number corresponding to the height 4 of a case 10. The case height 4 for cases 10 typically ranges about 6" to 14" and machine 24 includes case height and positions along the scales corresponding to this range. In the event of a case height 4 change, vertical quick release levers 106, 108 are loosened and rollers 98, 100 are repositioned with the pointers aligned with a predetermined point along the scales (not shown) and then levers 106, 108 are retightened securing rollers 98, 100 in the proper relation to the new case height 4 without the need to position a case 10 within the infeed section 26.

To accommodate a change in case length 2, case hold down roller assemblies 94, 96 include two pairs of horizontal quick release levers 122, 124 releasably securing stands 102, 103 to mounting plates 104, 105. Pointers 126, 128 are integrally included in stands 102, 103 and together with scales 130, 132 attached to mounting plates 104, 105 indicate a number on the scales 130, 132 corresponding to a case length 2. To effect a case length change levers 122, 124 are loosened and stands 102, 103 are positioned along slots 134, 136 with pointers 126, 128 aligned with a location on scales 130, 132 corresponding to case length 2. Once the proper length is selected levers 122, 124 are retightened to secure rollers 98, 100 in the preselected position.

It is within the scope of the present invention that case hold down roller assemblies 94, 96 include a pair of actuators to accommodate case height changeovers. The actuators are electrically coupled to processor 5 (FIG. 2A) by any suitable means to allow an operator to input a case height 4 in to the processor 5 and effect a proper positioning of rollers 98, 100 along stands 102, 103.

Figure 5B:
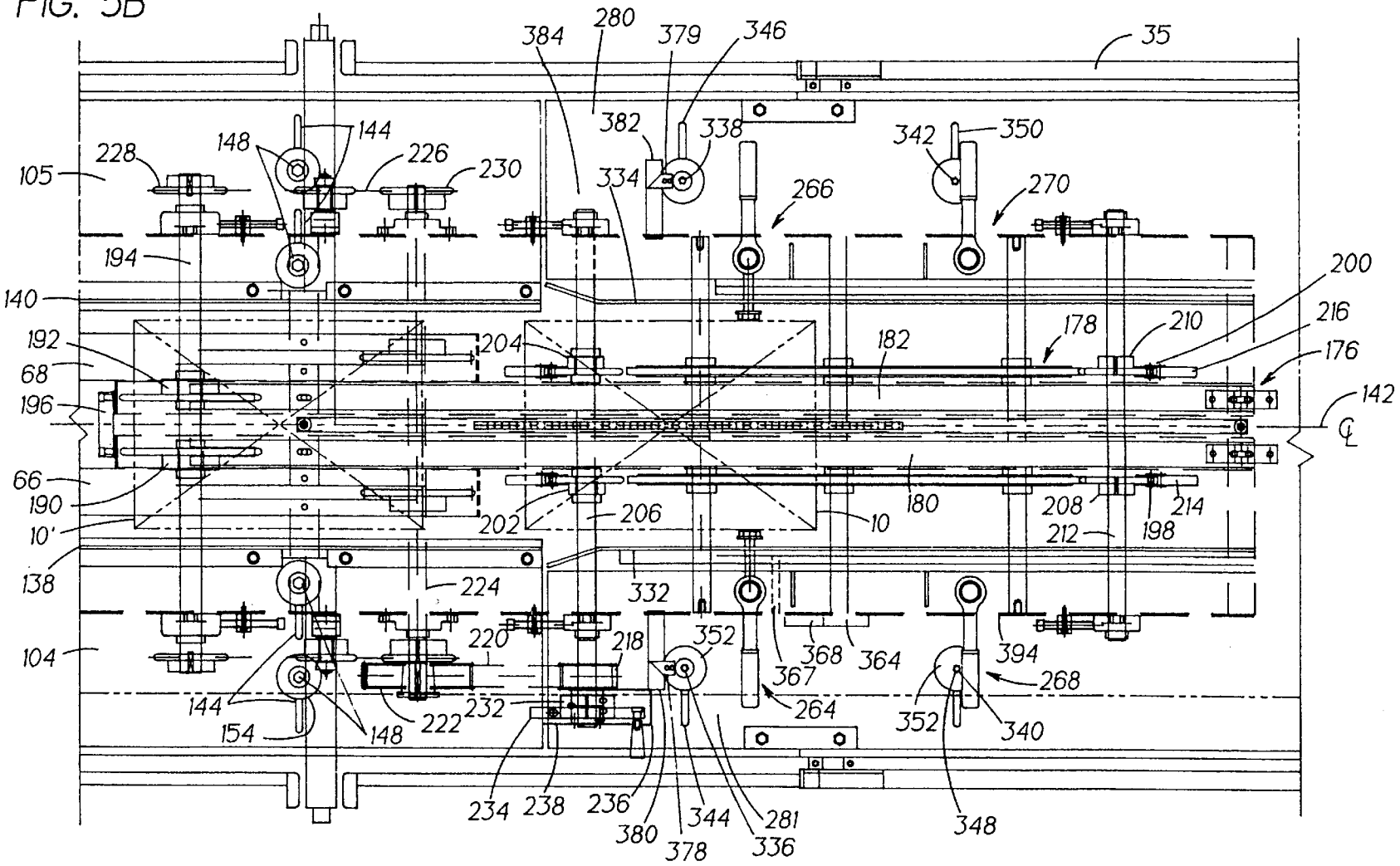
FIG. 5B is a top plan view of the lifting and warping section of a tab lock slitter machine in accordance with the present invention.

Referring to FIGS. 5A and 5B infeed section 26 further includes case guides 138, 140 which align and guide cases 10 along chains 66, 68 of transport assembly 34. Case guides 138, 140 are attached to mounting plates 104, 105 and are positioned apart from one another allowing clearance for the width 3 of a case 10 and are set equidistant from machine centerline 142. Mounting plates 104, 105 include four pairs of slots 144 with four pairs of studs 148 attached to machine frame 35 disposed within the slots and four sets of hold down assemblies 152, 153, 154, and 155 (FIGS. 5A and 5B) engaging the studs 148 and slidable securing the mounting plates 104, 105 to the machine frame 35. In the event of a case width 3 change the present invention includes a master guide adjuster 330 including the case guides 138, 140 of the infeed section, as described herein below in relation to the transport and warping section 28.

Figure 5C:
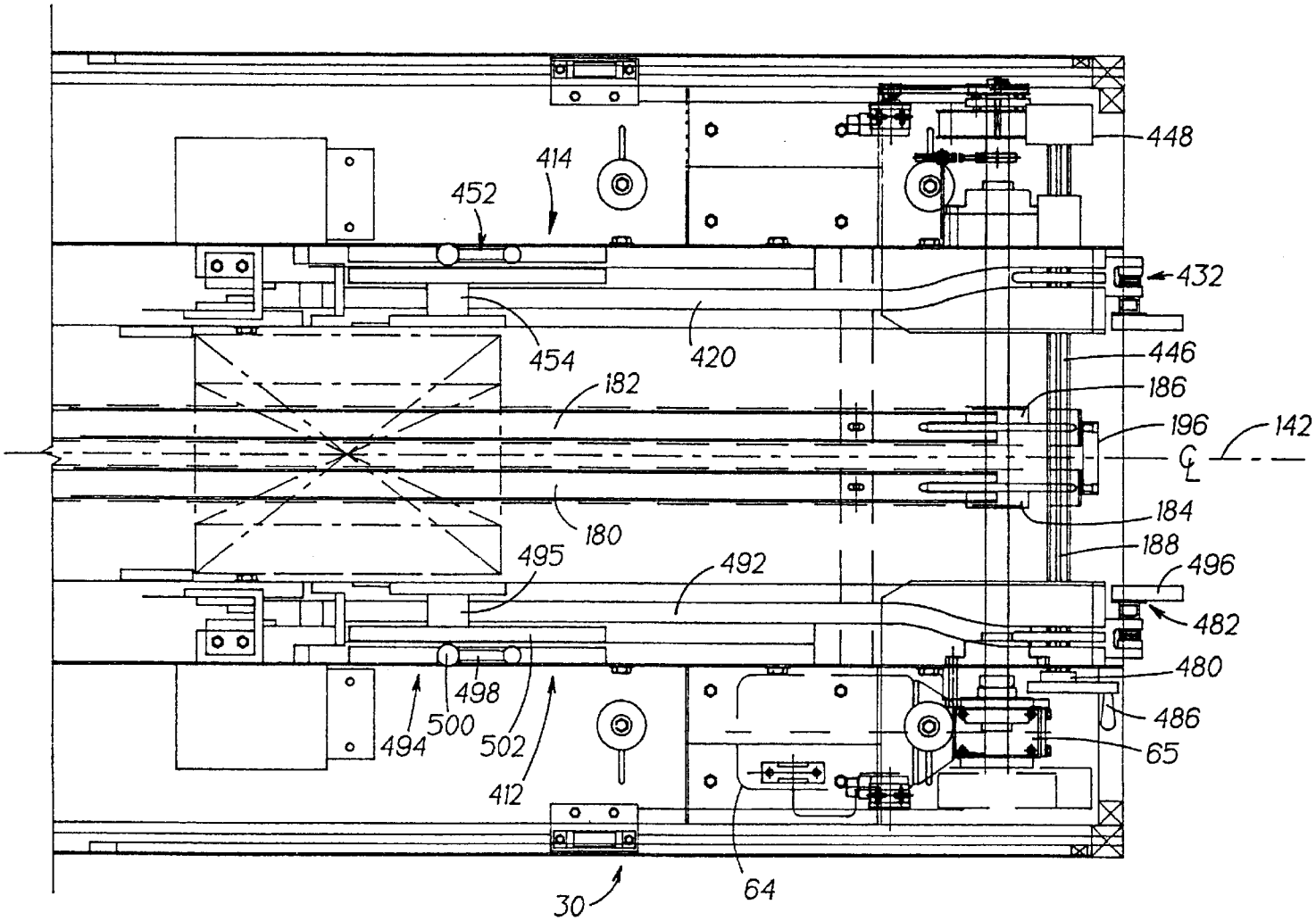
FIG. 5C is a top plan view of the flap section of a tab lock slitter machine in accordance with the present invention.
Figure 6:
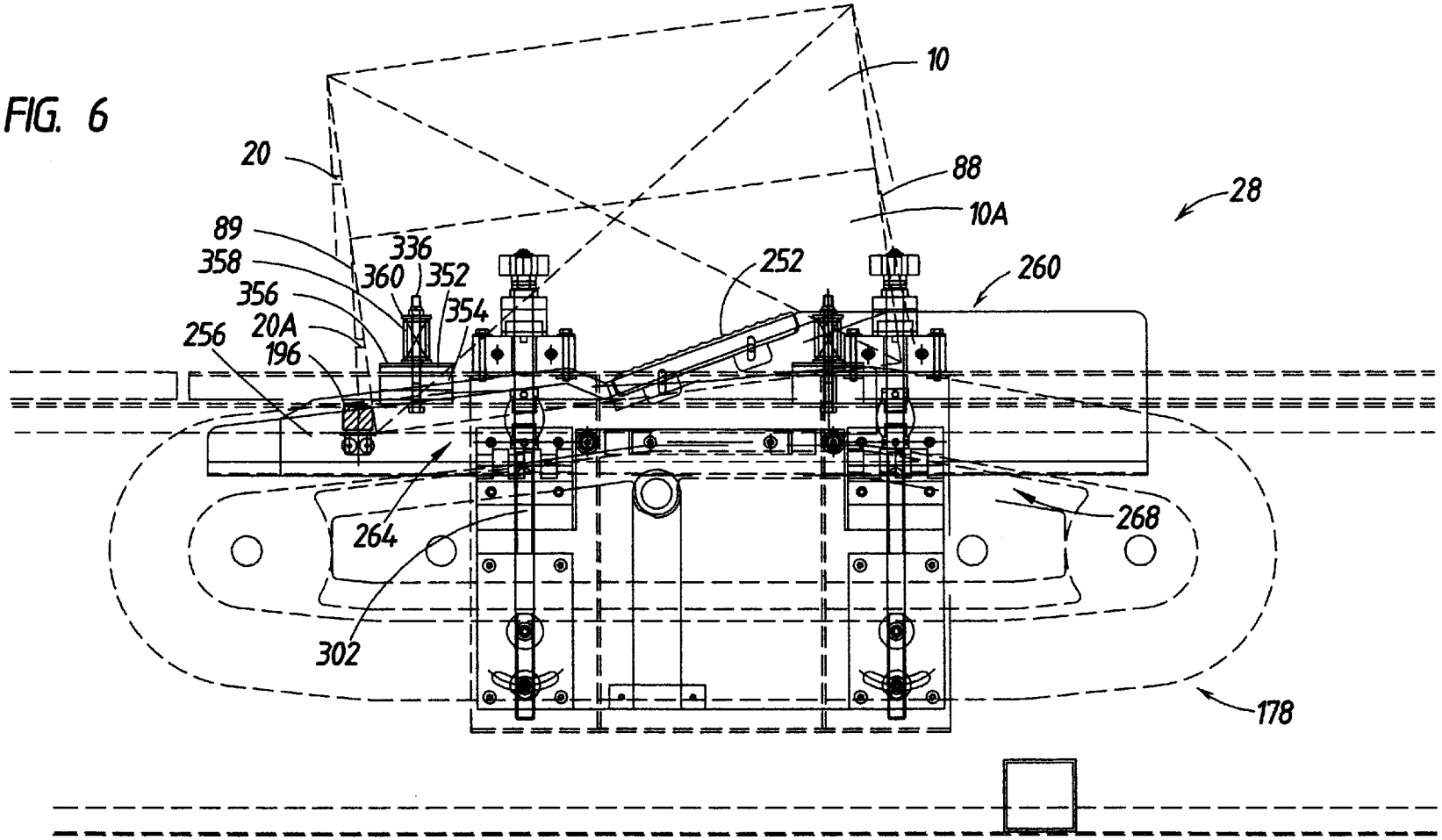
FIG. 6 is a side plan view of the knife guide adjusters.

The main transport drive system 176 and warping drive system 178 of the transport and warping section 28 of slitter machine 24 are best shown in FIGS. 5B, 5C and 6. Main transport drive system 176 consists of a pair of flat-topped main flight chains 180, 182 driven by main motor 64 and gear reducer 65 via drive sprockets 184, 186 attached to drive shaft 188 and driven on sprockets 190, 192 mounted on shaft 194. Main transport drive system 176 further includes ten transport lugs 196 attached to main flight chains 180, 182 and equally spaced about their length. In one embodiment of the present invention the lugs are spaced 30 inches apart from one another. Cases 10 are delivered to the transport and warping section 28 by flat top chains 66,68 of the infeed timer 32 as described herein above. Transport lugs 196, as best shown in FIG. 6, are driven by case transport chains 180, 182 (FIG. 5B) at a speed greater than that of the flat top chains 66, 68. In an embodiment, for example, the ratio between flat top chains 66, 68 (FIG. 2A) and case transport chains 180, 182 is 4:5. The effect of the speed differential changes control of case 10 from leading edge 88 in the infeed section 26 to trailing edge 89 in the transport and warping section 28. Cases 10 are driven by transport lugs 196 against trailing edge 89 through the warping section 28 and through the flap tucker section 30 as described herein below. The slitter machine 24 of the present invention separates the warping drive from the transport drive and in so doing reduces the weight on the main flight chains 60, 61 by 90% and reduces the complexity of effecting a case length 2 change over the prior art.

With reference to FIGS. 5B and 6, warping drive system 178 includes a pair of warping chains 198, 200 mounted to sprockets 202, 204 on drive shaft 206 and sprockets 208, 210 on idler shaft 212. The shafts are mounted within bearing blocks attached to machine frame 35 as known in the art. The warping system 178 further includes three sets of two lifting lugs 214, 216 as best shown in FIG. 5B. Lifting lugs 214, 216 lift the leading end of case 10 off of main flight chains 180, 182 while the trailing end of case 10 remains on the main flight chains with trailing edge 89 in contact with transport lug 196 (FIG. 6). In accordance with the present invention lifting lug 216 has a higher profile than lifting lug 214 and in contacting case 10 warps the case exposing leading lock tab 22 and trailing lock tab 20 so that they may be severed by knives as will be described herein below. Shaft 212, which drives warping chains 198, 200, includes timing pulley 218 which is driven via timing belt 220 connected to drive pulley 222 mounted to intermediate shaft 224. The speeds of the main flight chains 180, 182 and the warping chains 198, 200 are synchronized by directly driving intermediate shaft 224 from shaft 194 via chain 226, sprockets 228, 230 and drive pulley 222, timing belt 220 and timing pulley 218. As best shown in FIG. 2B lifting lugs 214, 216 are preferably positioned about 1" of the leading edge 88. It is often necessary to change the position of lifting lugs 214, 216 relative to transport lug 196 to accommodate cases of differing length 2. In one embodiment of the present invention a phase adjuster 232 (FIG. 5B) such as manufactured by Harmonic Drive Technologies, Inc., is mounted to shaft 206 enabling the repositioning of lifting lugs 214, 215 relative to transport lugs 196. The phase adjuster 232 includes an inner hub (not shown) attached to shaft 206 having a gear mounted on its outer surface and an outer hub (not shown) having a gear for engagement with the inner hub and providing a 100:1 ratio between the outside hub and the shaft. Phase adjuster 232 further includes an adjuster wheel 234 mounted to the outer hub, a pointer 236 fixed to machine frame 35 and rotary scale 238 fixed to the inner hub portion of the phase adjuster. To effect a change in position between the lifting lugs 214, 216 and the transport lugs 196 adjuster wheel 234 is rotated and shaft 206 likewise advances or retards at a ratio equal to the phase adjuster, in this example 100:1, until pointer 236 is aligned with a number on scale 238 corresponding to the proper position for the lugs given the new case length. This adjustment is made while the machine 24 is not operating and without the need to position a case within the machine.

It is within the scope of the present invention that phase adjuster 232 include an actuator to accommodate case length changeovers. The actuators are electrically coupled to processor 5 by any suitable means to allow an operator to input a case length 2 into the processor and effect a proper positioning of lifting lugs 214, 216 relative to the transport lugs 196.

Figure 9A:
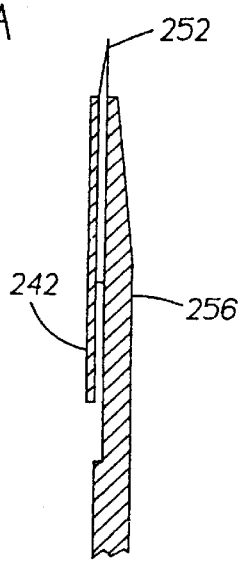
FIG. 9A is cross sectional view of a knife and guide assembly.
Figure 7:
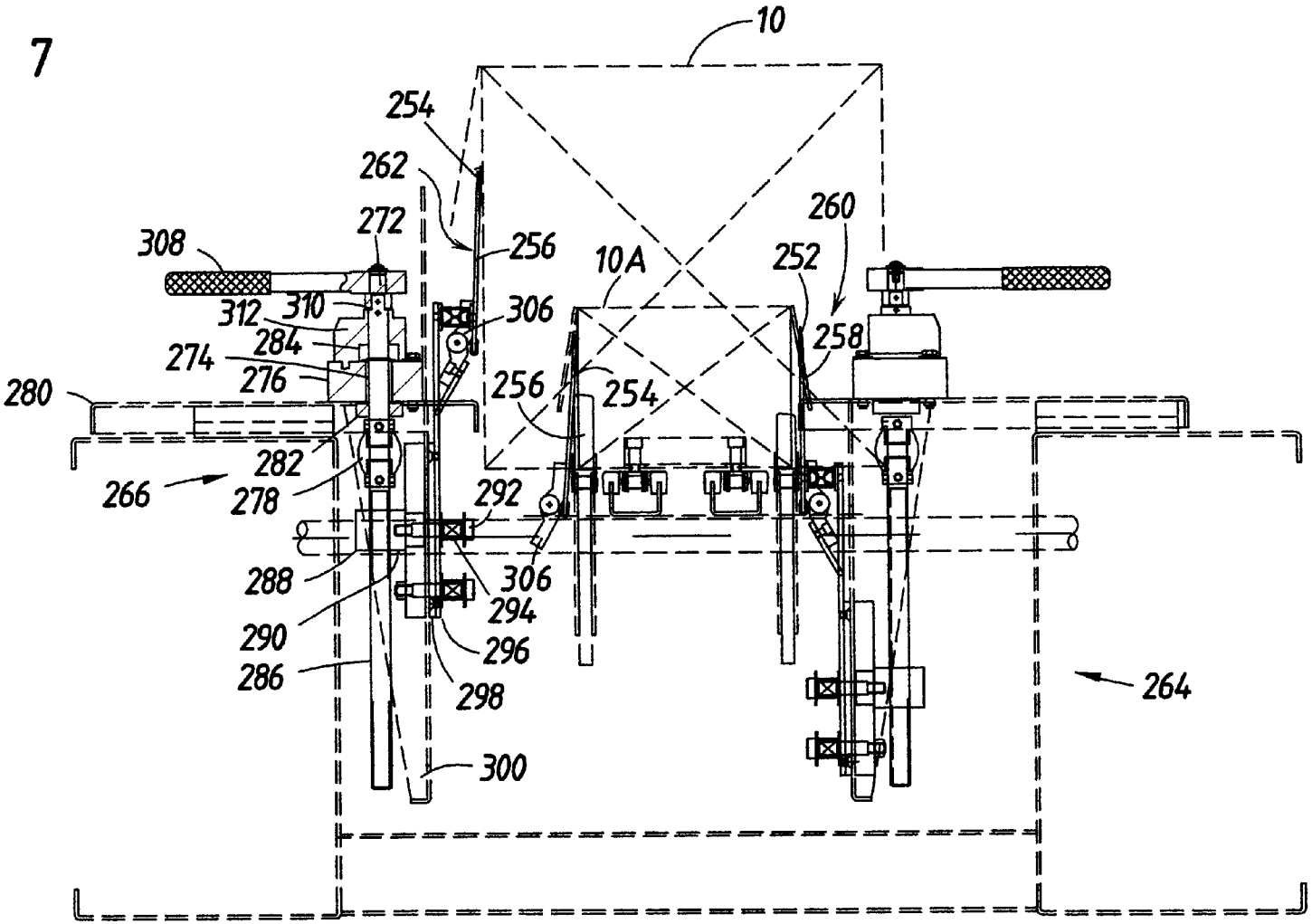
FIG. 7 is an end plan view in partial section of the knife guide adjusters.

As case 10 moves along warping section 28, tab locks 20, 22 are slit by a pair of knives 252, 254 mounted on knife guides 256, 258 similar to that of the prior art as is best shown in FIGS. 6 and 7. As in the prior art, knife 252 slits trailing tab lock 20 and knife 254 slits leading edge tab lock 22. In accordance with the present invention, knife guide assemblies 260, 262 include removable knife blades 252, 254 as best shown in FIG. 9A. Backing plate 242 is fastened to knife guide 256 and releasably secures knife blade 252 to the guide. Blade 254 is secured to guide 258 using the same configuration. These features allow the blades to be quickly and easily removed for replacement or sharpening.

Knife guide assemblies 260, 262 further include vertical adjustment assemblies 264, 266, 268, 270 for proper positioning of knives 252, 254 in relation to tab locks 20, 22 for various heights 4 of cases 10. With reference to FIG. 6, knife 252 is adjustable from the position for slitting trailing tab 20A of a short case 10A to the position shown in phantom for slitting a trailing tab 20 on a tall case 10. Vertical adjustment assemblies 264, 266, 268, 270 function similar to one another and as best shown in FIG. 7 with reference to assembly 266 include an upper adjusting shaft 272 rotatably engaged within a bronze bushing 274 disposed within mounting block 276 and attached to universal joint 278. Mounting block 276 is secured to mounting plate 280 and upper shaft 272 is retained within bushing 274 by clamping collar 282 and retaining spring 284. Assembly 266 further includes lower adjustment shaft 286 comprised of a threaded rod attached to universal joint 278 and threadably engaged within adjustment block 288. Adjusting block 288 mates with plastic adjusting washer 290 and threadably engages shoulder bolt 292 which together with compression spring 294 biases side 296 and plastic side plate 298 against bracket 300. In an embodiment of the present invention washer 290 is comprised of an ultra high molecular weight plastic to reduce friction between side plate 298 and adjustment block 288 during vertical adjustment. Compression spring 294 may advantageously comprise a spring washer assembly to provide a biasing force. Bracket 300 is mounted to mounting plate 280 and includes slot 302 (FIG. 6) for shoulder bolt 292 to pass through. Knife 254 is attached to knife guide 256 and further attached to side plate 296 via hinge 306 to accommodate tolerances on the width of cases 10 up to 0.13 inches. Vertical adjustment assembly 266 further includes ratchet 308 attached to upper adjustment shaft 272 via adapter to provide mechanical advantage for applying torque to the upper shaft. Also disposed on the upper shaft is digital counter 312 having a display 314 (FIG. 7) displaying a digital number corresponding to the relative height of knife 254. To effect a change in the height of knife 254 to accommodate a different case height 4 ratchet handle 308 is turned either in a clockwise direction whereby adjustment block 288 progresses up the threads of lower adjustment rod 286 thereby raising knife 254 or ratchet handle 308 is turned counterclockwise whereby the adjustment block will descend the threads of the lower adjustment rod thereby lowering the height of knife 254. A number corresponding to a height setting for each of the vertical adjustment assemblies 264, 266, 268, 270 is provided to allow an operator to set the height of the knife guides 304 by turning ratchet 308 the appropriate direction and amount until the digital display of counter 312 agrees with the predetermined number. The vertical adjustment assemblies 258, 264, 266, 268 and 270 allow for a quick an accurate adjustment of the four corners of the knife guides 256, 258 without running the machine and without installing a case within the machine.

It is within the scope of the present invention that vertical adjustment assemblies 264, 266, 268, 270 include an actuator to accommodate case height changeovers. The actuators are mechanically coupled to the upper adjusting shafts 272 and electrically coupled to processor 5 by any suitable means to allow an operator to input a case height 4 into the processor and effect a proper positioning of the knife guide assemblies 260, 262.

Figures 8B, 9:
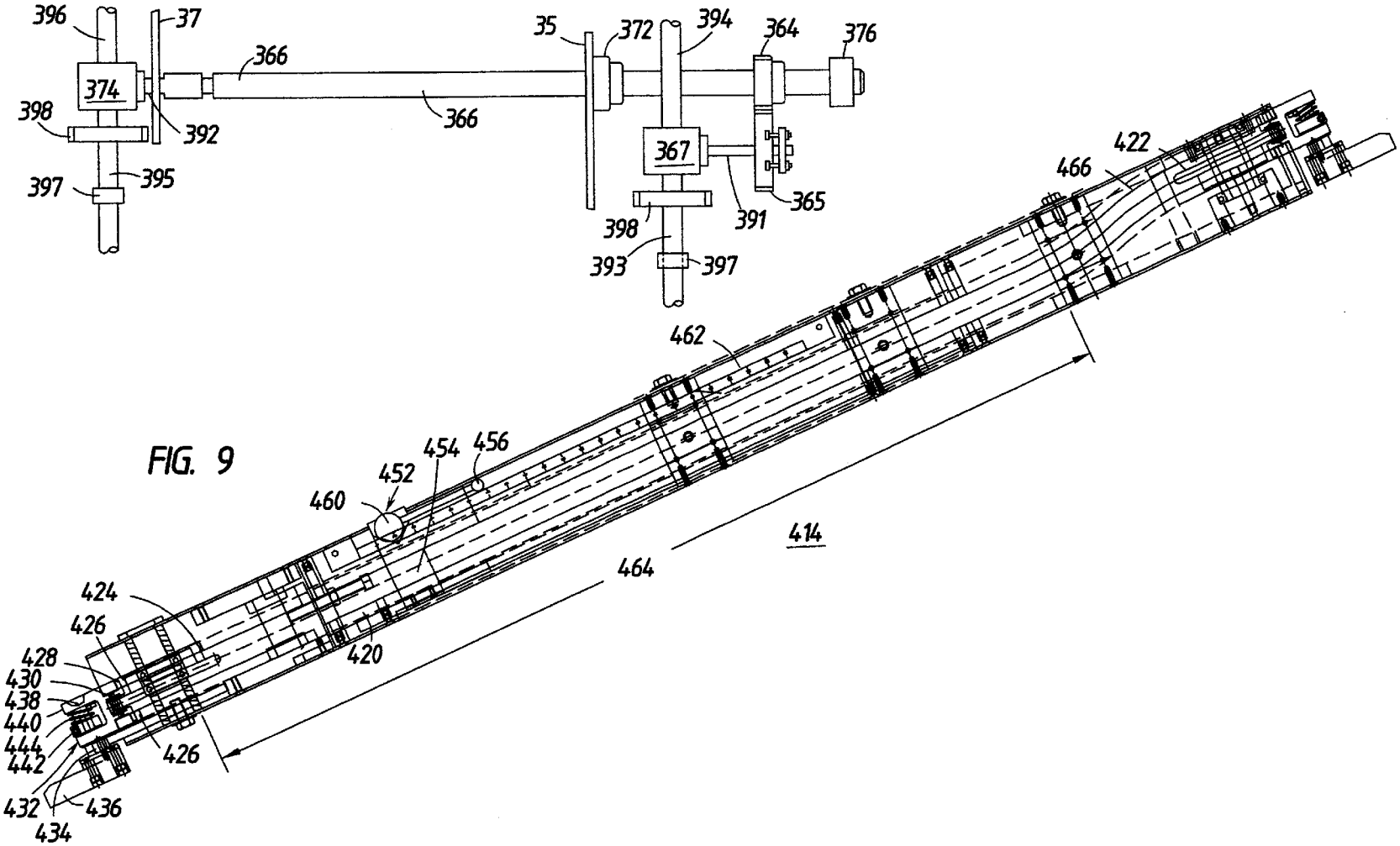
FIG. 8B is schematic view of the positioning mechanism of the master guide adjuster.
FIG. 9 is a top plan view of the trailing flap lifter assembly.

With reference to FIGS. 5A, 5B, and 8A a master guide shown generally as 330 is provided to allow a single point adjustment of case guides 138, 140, 332, 334 along their lengths within transport and warping section 28 and infeed section 26. Case guides 332, 334 are attached to mounting plates 280, 281 and, similar to the infeed section 26, are mounted to machine frame 35 via four frame mounted studs 336, 338, 340, 342 disposed within slots 344, 346, 348, 350. A pair of ultra high molecular weight plastic washers 352, 354 are installed on each of the studs on either side of the mounting plates and a washer 356, compression spring 358 and lock nut 360 are mounted on top of each plastic washer 352 to bias mounting plates 280, 281 towards machine frame 35. The mounting arrangement also allows mounting plates 280, 281 to slide on plastic washers 352, 354 in and out relative to machine centerline 142. Referring to FIG. 8A there is shown positioning assembly 362, 363 of the master guide 330. Adjustment rod 366 is mounted within a bearing 372 attached to machine frame 35 and a right angle drive gearbox 374 attached to machine frame 35. As best shown in FIGS. 8A and 8B positioning assembly 363 includes reversing gears 364, 365 mounted to adjustment rod 366 and gearbox 367 respectively. Rotating ratchet 376 causes reversing gear 365 to rotate input shaft 391 on gearbox 367 and input shaft 392 on gearbox 374. Drive shafts 393, 394 extend from gearbox 367 and drive shafts 395, 396 and from gearbox 374 and are rotatably mounted to machine frame 35 by pillow blocks 397. Pinion gears 398 are mounted to drive shafts 393–396 and engage each gear segments 399 secured to mounting plates 104, 105, 280, 281. The rotation of ratchet handle 376 causes drive shafts 393–396 and pinion gears 398 to rotate thereby engaging and translating rack gears 399 and mounting plates 104, 105, 280, 281 translate in and out relative to centerline 146. Master guide 330 includes a ratchet 376 (FIG. 8A) attached to adjustment rod 366 to provide mechanical advantage for applying torque to the adjustment rod 366. In the event of a case width 3 change an operator rotates ratchet 376 clockwise as viewed in FIG. 2B to displace the case guides 138, 140, 332, 334 roller assemblies 110,112, and other components attached to the mounting plates 104, 105, 280, 281 farther apart from one another. An operator rotates the ratchet 376 counter clockwise (as viewed in FIG. 2A) to move the case guides 138, 140, 332, 224 closer to one another. Referring to FIG. 5B, case guides 138, 140, 332, 334 are moved to the proper position during a case width change by alignment of pointers 378, 379 attached to studs 336, 338 to a number on scales 380, 382 mounted to mounting plate 281, 280.

It is within the scope of the present invention that master guide 330 includes an actuator to accommodate case width changeovers. The actuator replaces ratchet 376 and is electrically coupled to processor 5 by any suitable means to allow an operator to input a case width 3 into the processor and effect a proper positioning of the case guides.

Referring to FIGS. 2C, 5C, 9 and 10 flap tucker section 30 functions similar to the prior art as described herein above however certain improvements have been made to the minor flap lift assemblies 412, 414 and rear flap tucker assembly 416. Minor flap lift assembly 414 serves to lift trailing flap 14 of case 10 positioning it for flap tucker 416 to close the flap and minor flap lift assembly 412 operates to lift leading flap 12 positioning it for plow portion 418 of tucker wheel 419 to close the flap prior to the case exiting slitter machine 24. Referring to FIG. 9 there is shown minor flap lift assembly 414 including a chain track 420, drive sprocket 422 and idler sprocket 424 mounted on either end. Chain track 420 includes a groove 426 along the length to slidably engage a pair of fingers 428 extending from the flat top chain 430 thereby guiding the chain along the track. Four tear drop assemblies 432 are attached to chain 430 at equally spaced intervals in one embodiment they are spaced at 33 inches, and include cam follower 434 and tear drop 436 mounted on pivot shaft 438 rotatably disposed within pivot casing 440. Collar 442 is clamped to pivot shaft 438 retaining the shaft within casing 440 and cooperates with spiral spring 444 to bias cam follower 434 and tear drop 436 against chain track 420. With the pivot shaft 438 supported within pivot casing 440 wear of the assembly is reduced over the prior art and alignment of the tear drop in relation to the minor flaps is enhanced. With reference to FIGS. 2C, 5C, 9 and 10 chain 430 and tear drop assemblies 432 travel within chain track 420 being driven by sprocket 422 connected to spline shaft 446, connected to timing pulley 448 and operably connected to motor 64 by timing belt 450. In operation, case 10 flows along machine bed 31 and enters flap tucker section 30 with tab locks 20, 22 severed as described herein above. Chain 430 and attached tear drop assemblies 432 of minor flap lifter 414 are timed with transport lug 196 (FIG. 2B) such that as case 10 enters flap tucker section 30 a tear drop assembly 432 is positioned within an inch of the trailing edge 89 and minor flap 14 of case 10 and travels behind case 10 at the same speed along the direction indicated by arrow 23. As case 10 progresses along the machine bed 31 in the direction indicated by arrow 23 tear drop assembly 432 progresses at an incline along straight section 464 of chain track 420 moving inside of flap 14. Cam follower 434 comes into contact with cam 454 and tear drop 436 pivots counter clockwise as viewed in FIG. 2C and serves to rotate flap 14 toward a closed position. As tear drop assembly continues along chain track 420 cam follower 434 drops off of cam 454 and tear drop 436 rotates clockwise and moves up along flap 14 further rotating the flap into a closed position and preparing the flap for contact with flap tucker 416 as will be described more fully herein below. In accordance with the present invention tear drop assembly 432 then enters curved section 466 and is moved laterally away from machine centerline 142 and out from behind the trailing edge 89 of the case and proceeds around drive sprocket 422 and back along the back side of chain track 420.

With reference to FIG. 9, minor flap lifter assembly 414 further includes adjustable cam assembly 452 mounted to chain track 420 including cam 454 quick release lever 456 and cam block 458 slidably attaching the cam to the chain track 420 and further including pointer 460 and scale 462 for proper positioning of the cam. As described herein above the trailing end of cases 10 travel along machine bed 31 at the same rate regardless of case size and as such minor flap lifter 414 requires no adjustment to accommodate for case length 2 changes. Advantageously minor flap lifter 414 includes adjustable cam assembly 452 to quickly and accurately accommodate changes to case height 4. In operation, there is a set of numbers corresponding to the height of different cases and those numbers are provided on scale 462. In order to effect a case height 4 change an operator loosens quick release handle 456 and slides adjustable cam assembly 452 to a position where pointer 460 aligns with the predetermined number on scale 462. This assures that cam follower 434 contacts the cam and positions tear drop 436 against flap 14 at the proper position without the need for running machine 24 and without positioning a case 10 within the flap tucker section 30 to effect the adjustments for a height change.

It is within the scope of the present invention that cam assembly 452 includes an actuator to accommodate case height 4 changeovers. The actuator is mechanically coupled to cam 454 and is electrically coupled to processor 5 by any suitable means to allow an operator to input a case height 4 into the processor and effect a proper positioning of the cam 454.

Figure 10:
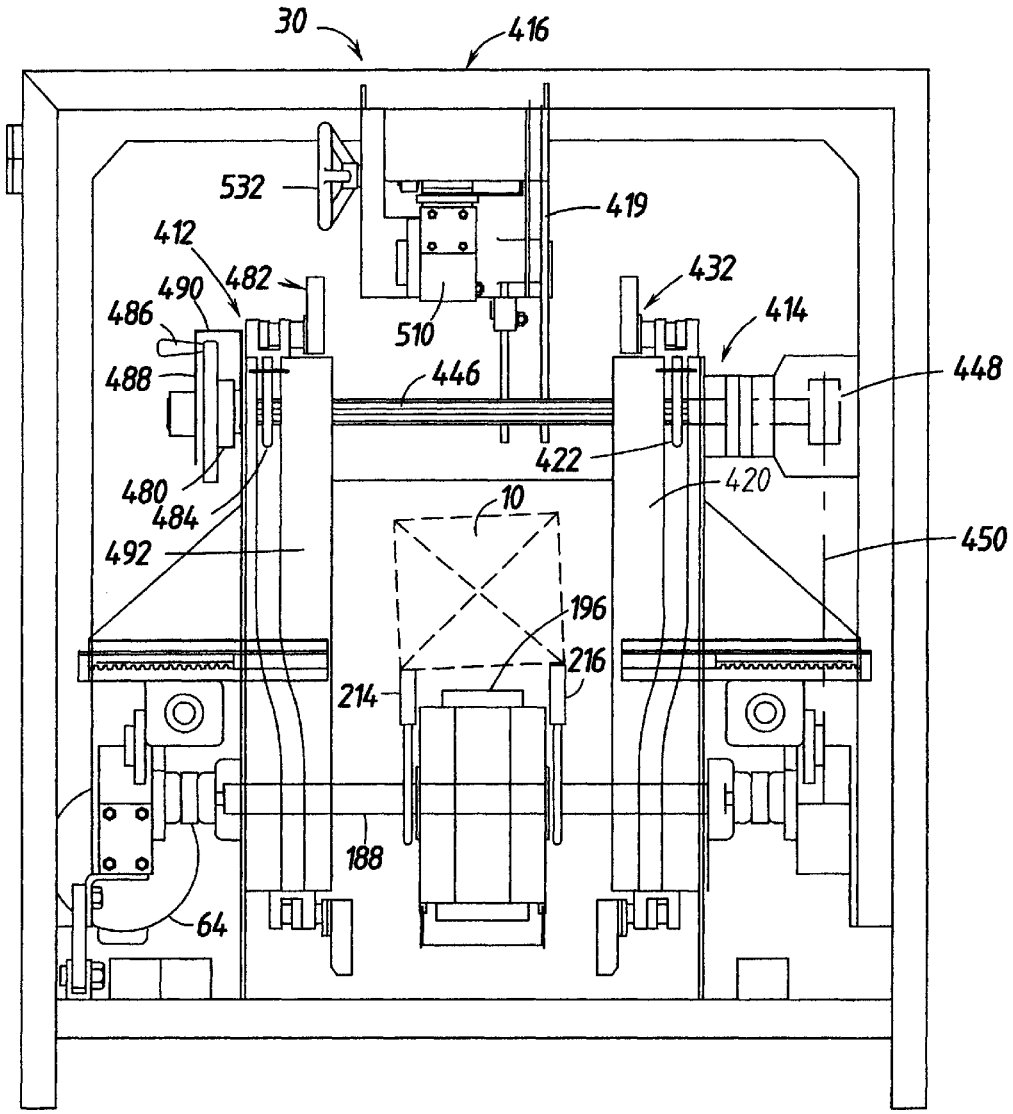
FIG. 10 is an end plan view of the flap tucker assembly of the tab lock slitter in accordance with the present invention.
Figure 5B:
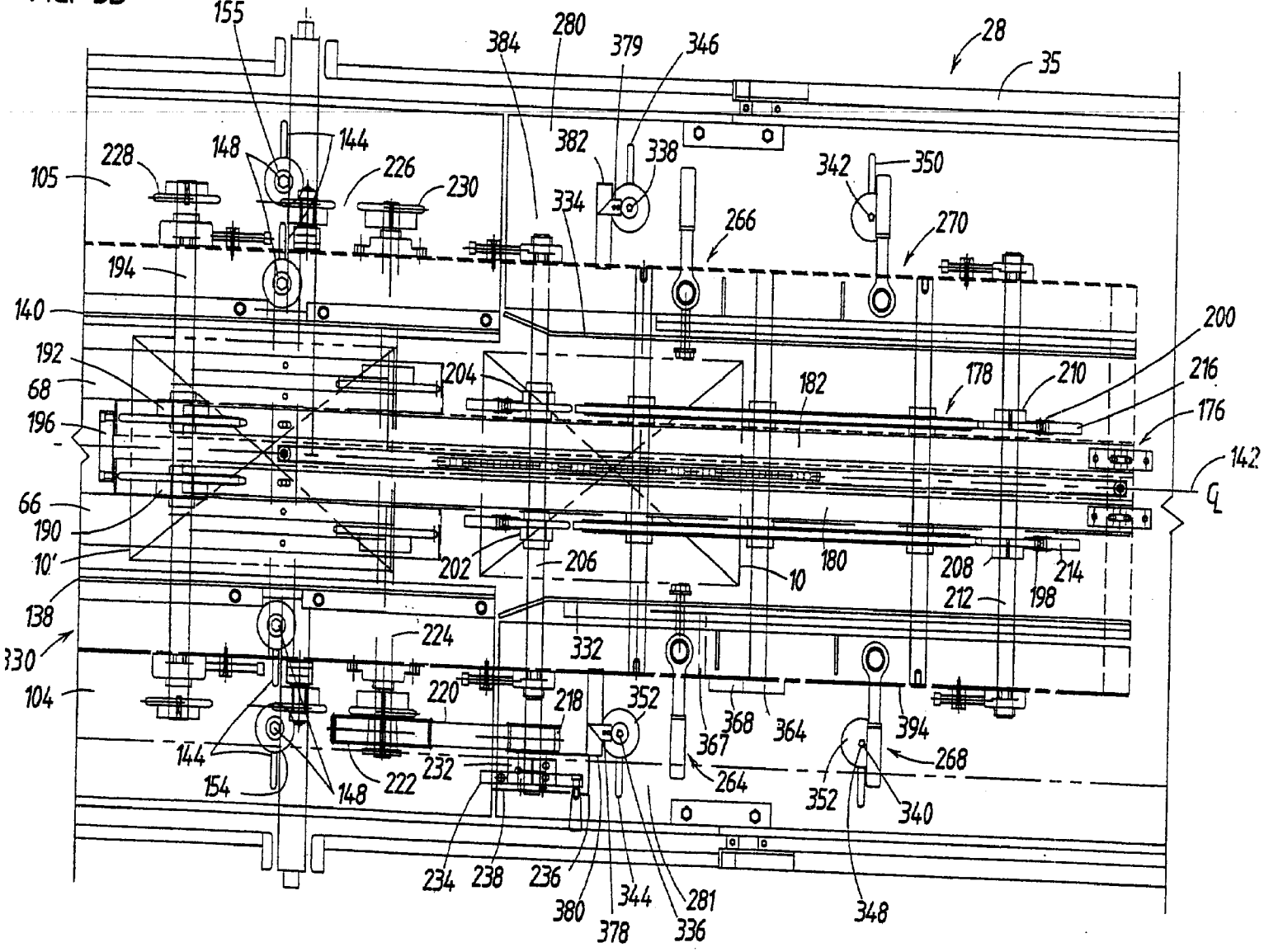

Minor flap lifter 412 as shown in FIG. 10 functions similar to flap lifter 414 except that it serves to lift leading flap 12 of case 10. Minor flap lifter 412 further includes phase adjuster 480 to effect a change in the relative distance between tear drop assemblies 432 on trailing flap lifter 414 and tear drop assemblies 482 on leading flap lifter 412 to accommodate changes in length 2 of case 10. With reference to FIG. 13 phase adjuster 480 is mounted to drive sprocket 484 and spline shaft 446 and includes adjuster wheel 486, rotary scale 488 and pointer 490. Phase adjuster 480 functions similar to that of phase adjuster 232 (FIG. 5B) which positions the lifting lugs relative to the transport lugs to accommodate case length changes. Adjuster wheel 486 is rotated by an operator until pointer 490 is aligned with a predetermined number on rotary scale 488 corresponding to a particular case length 2. Once set at the appropriate number tear drop assembly 482 will be positioned approximately one inch from the leading edge 88 of case 10, will move up and between the leading edge 88 and leading flap 12 as the tear drop assembly 482 progresses up the incline of chain track 492. Chain track 492 similarly includes a curved portion to displace tear drop assembly 482 away from machine centerline 142 and out of the way of case 10. Cam assembly 494, as best shown in FIG. 5C, functions similar to that of cam assembly 452 (FIGS. 5C and 9) using quick release lever 498, and pointer 500 and scale 502 to position the cam 495 to pivot tear drop 496 to rotate flap 12 up and into the proper position to contact plow portion 418 of tucker wheel 419 for a particular case height 4.

It is within the scope of the present invention that minor flap lifter 412 include and actuator coupled to phase adjuster 480 accommodate case length 2 changeovers. The actuator is electrically coupled to processor 5 by any suitable means to allow an operator to input a case length 2 into the processor and effect a proper positioning of the tear drop assemblies 482.

Minor flap lifters 412, 414 are attached to mounting plates 504, 506 and as such width adjustments to the lifters are advantageously effected by adjustment of the master guide as described herein above.

Rear flap tucker assembly 416 functions similar to that of the prior art as described herein above and further includes servo motor 510 and height adjuster assembly 512 as best shown in FIGS. 2C and 10. Servo motor 510 is mounted to tucker wheel 419 via shaft 514 mounted within hub 516. During operation tucker wheel 419 is driven by servo motor 510 at a constant speed for 120 degrees of rotation dependant upon machine speed settings. Once per revolution servo motor 510 accelerates tucker wheel 419 at twice the constant speed within a 60 degree arc just prior to tucking point 518 contacting trailing flap 14 and then drives the tucking point through the rest of the arc after tucking the trailing flap. After tucking the flap the servo motor 510 again drives the wheel 419 at a constant speed for a second 120 degrees followed by a second 60 degree arc wherein the wheel 419 is driven at half the constant speed.

The position of tucker wheel 419 in relation to machine bed 31 is adjustable to accommodate cases 10 of varying height 4. In order to effect a height adjustment of tucker wheel 419 hand crank 532 of height adjuster 512 is rotated in the proper direction rotating pinion gear 534 in meshing arrangement with rack gear 536 thereby moving tucker wheel 419 along leg 538 of adjuster frame 540. Height adjuster 512 further includes pointer 542 and scale 544 attached to leg 538 which allows an operator to rotate hand crank 532 until the pointer 542 aligns with a predetermined number on scale 544 corresponding to the proper height 4 of a particular case 10. It is important to note that rack gear 536 is positioned at about the same general angle relative to machine bed 31 as minor flap lift assemblies 412, 414. The configuration of rack gear 536 advantageously allows for a height adjustment of tucker wheel 419 through a linear movement along the rack gear.

It is within the scope of the present invention that height adjuster 512 includes an actuator to accommodate case height 4 changeovers. The actuator replaces hand crank 532 and is mechanically coupled to pinion gear 534 and is electrically coupled to processor 5 by any suitable means to allow an operator to input a case height 4 into the processor and effect a proper positioning of the tucker wheel 419.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A slitter machine of the type where tab lock cases of varying height, width, and length are advanced therethrough in a product flow direction on a machine bed by a main drive motor, the cases having a leading flap, a trailing flap, a leading end and a trailing end, a top and a bottom, the slitter machine having a frame, a centerline, a leading flap lifter assembly having a leading flap lifter and a trailing flap lifter assembly having a trailing flap lifter mounted to the frame at an incline relative to the machine bed, the leading flap lifter and the trailing flap lifter are mounted on opposite sides of the centerline, each flap lifter having tear drop assemblies attached to a respective drive chain and actuated by a pair of cams to rotate the leading flap and the trailing flap toward a closed position, the improvement comprising a chain track disposed in each of the flap lifting assemblies and each of the drive chains disposed within the chain track wherein the chain track has a first section having a first distance between the drive chains and a second section having a second distance between the drive chains, and wherein the second distance is greater than the first distance.

2. A slitter machine as set forth in claim 18 wherein the first section of the chain track positions the tear drops in contact with the cases and the second section of the chain track positions the tear drops away from the case.

3. A slitter machine as set forth in claim 1 wherein the drive chains follow the chain track such that the drive chains bend outward to increase a distance between the drive chains, and said outward bend is in a direction substantially perpendicular to the product flow direction.

4. An apparatus for tucking flaps on a case in a slitter machine, the case having a leading flap and a trailing flap, the apparatus comprising:

a frame;

a case transport chain operably connected to said frame, said case transport chain configured to transport the case along a plane;

a leading flap lift assembly operably connected to said frame on a first side of said case transport chain, said leading flap lift assembly including:

a first chain track operably connected to said frame at an angle relative to said plane, said first chain track including a first section and a second section, a first drive chain disposed within said first chain track, a first tear drop assembly disposed on said first drive chain, a first cam disposed proximate said first chain track, said first tear drop assembly contacting said first cam to rotate the leading flap towards a closed position;

a trailing flap lift assembly operably connected to said frame on a second side of said case transport chain opposite said first side, said trailing flap lift assembly including:

a second chain track including a third section generally parallel to said first section and a fourth section generally parallel to said second section, said first section and said third section are separated by a first distance, said second section and said fourth section are separated by a second distance greater than said first distance, a second drive chain disposed within said second chain track, a second tear drop assembly disposed on said second drive chain, and a second cam disposed proximate said second chain track, said second tear drop assembly contacting said second cam to rotate the trailing flap towards a closed position.

5. The apparatus of claim 4 further including:

a phase adjuster operably secured to said first drive chain to adjust a distance between said first cam and said second cam.

6. The apparatus of claim 4 wherein said first cam is slidably secured to said first chain track to accommodate changes in case height.

7. The apparatus of claim 6 further including an actuator operably connected to said first cam to slide said first cam along said first chain track.

8. The apparatus of claim 4 further including:

a tucker wheel rotatably mounted to said frame, said tucker wheel having a tucker point disposed thereon, the leading flap contacts said tucker wheel for rotating said leading flap towards said closed position, and the trailing flap contacts said tucker point for rotating said trailing flap towards said closed position.

9. The apparatus of claim 8 wherein said tucker wheel translates relative to said plane to accommodate changes in case height.

10. The apparatus of claim 9 wherein said tucker wheel is secured to said frame by a rack and pinion gear.

11. The apparatus of claim 10 wherein a rack portion of said rack and pinion gear extends generally parallel to said first chain track.

12. The apparatus of claim 10 wherein said pinion gear is driven by an actuator.

* * * * *

UNITED STATES PATENT AND TRADEMARK OFFICE

CERTIFICATE OF CORRECTION

PATENT NO. : 6,318,049 B1
DATED : November 20, 2001
INVENTOR(S) : Raudat, J. et al.

It is certified that error appears in the above-identified patent and that said Letters Patent is hereby corrected as shown below:

Drawings sheet, consisting of Fig. 5B, should be deleted to be replaced with the drawing sheet, consisting of Fig. 5B, as shown on the attached page.

Column 7,
Line 66, before "assembly" delete "Referring to FIG. 2A', transport" and insert therefor -- Transport --.

Column 15,
Line 35, after "claim" delete "18" and insert therefor -- 1 --.

Signed and Sealed this

Thirteenth Day of December, 2005

JON W. DUDAS
*Director of the United States Patent and Trademark Office*